United States Patent [19]

Ferro et al.

[11] 4,070,602

[45] Jan. 24, 1978

[54] SPATIALLY DISTRIBUTED WINDINGS TO IMPROVE PLASMA COUPLING IN INDUCTION IONIZED LAMPS

[75] Inventors: Armand P. Ferro, Schenectady; Harold A. Gauper, Jr., Scotia, both of N.Y.

[73] Assignee: General Electric Co., Schenectady, N.Y.

[21] Appl. No.: 733,206

[22] Filed: Oct. 18, 1976

[51] Int. Cl.[2] ..... H05B 41/16; H05B 41/24

[52] U.S. Cl. ..... 315/248; 315/57

[58] Field of Search ..... 315/248, 344, 267, 56, 315/57, 70, 111.4, 111.5, 348

[56] References Cited

U.S. PATENT DOCUMENTS

| | | | |
|---|---|---|---|
| 4,005,330 | 1/1977 | Glascock et al. | 315/248 |
| 4,017,764 | 4/1977 | Anderson | 315/248 |

*Primary Examiner*—Alfred E. Smith
*Assistant Examiner*—Robert E. Wise
*Attorney, Agent, or Firm*—Lawrence D. Cutter; Joseph T. Cohen; Jerome C. Squillaro

[57] ABSTRACT

The distribution of turns in the primary winding of an induction ionized discharge lamp varies as a function of angular position on a toroidal core. The turns are wound in proportion to the adjoining secondary plasma flux density. Local matching of flux linkages per ampere reduces leakage flux between the primary and secondary and thereby improves lamp coupling and reduces electromagnetic interference.

6 Claims, 8 Drawing Figures

SPATIALLY DISTRIBUTED WINDINGS TO IMPROVE PLASMA COUPLING IN INDUCTION IONIZED LAMPS

This invention relates to fluorescent lamps which are adapted as direct replacements for existing incandescent lamps. More specifically, this invention concerns coupling transformers which act to reduce electromagnetic interference in fluorescent lamps wherein a transformer with a closed loop core is centrally disposed in a lamp envelope.

BACKGROUND OF THE INVENTION

The incandescent lamp is the primary luminary for household and residential lighting. This lamp generally includes an incandescent filament within a predetermined non-oxidizing atmosphere which is contained within a tear-drop shaped envelope and mounted, for example, within an Edison-type base which is screwed into a permanent fixture or into a movable socket.

Despite their widespread use, incandescent lamps are relatively inefficient, producing only 15–17 lumens per watt of input power and have relatively short, unpredictable service lives. Fluorescent lamps, which have efficiencies as high as 80 lumens per watt, provide an attractive alternative to incandescent lighting. Conventional fluorescent lamps, however, require a long tubular envelope which, together with the need for auxiliary ballasting equipment, has somewhat limited their acceptance in the home lighting market. Increased residential use of fluorescent illumination, with attendant savings of energy, can be achieved from the development of fluorescent lamps which are directly compatible with existing sockets and incandescent lamp fixtures.

U.S. patent application Ser. No. 642,142, now issued U.S. Pat. No. 4,017,764, by John M. Anderson, filed Dec. 18, 1975 and assigned to assignee of this invention, describes an electrodeless fluorescent lamp adapted for economical substitution in place of existing incandescent lamps which comprises an ionizable medium contained within a phosphor coated globular envelope. A closed loop magnetic core, which may be ferrite, is contained within the ionizable medium to induce an electric field, ionize the medium, and stimulate visible light output. The core is energized by a radio frequency power source in the lamp base structure. Current flows from the power supply through a multi-turn winding on the core and induces a single turn current flow in a diffuse plasma linking the core.

U.S. patent application Ser. No. 642,056, allowed by the Patent and Trademark Office on Aug. 4, 1976, now issued U.S. Pat. No. 4,005,330, which is assigned to the assignee of this invention, describes a similar electrodeless fluorescent lamp structure wherein a closed loop magnetic core is disposed through a central tunnel in a substantially globular fluorescent lamp. Current flow in the lamp is induced by a radio frequency power source in the manner described above.

The above-described electrodeless fluorescent lamps are highly efficient and substantialy free from electromagnetic radiation problems which characterized prior art, open-core induction ionized fluorescent lamp designs. In lighting installations which comprise large numbers of such lamps, however, the sum of the electromagnetic radiation produced may, in some cases, produce a source of electromagnetic interference (EMI) or exceed applicable government or industry standards.

It is, therefore, desirable to reduce the radiation of electromagnetic energy from induction ionized lamp structures.

SUMMARY OF THE INVENTION

The coupling of power to an induction ionized electrodeless fluorescent lamp depends on the magnetic coupling between a hard wire, multiple turn primary, and a diffuse single turn plasma which links its magnetic field. It is desirable to increase this coupling as much as possible in order to reduce electrical current requirements on the lamp power supply, improve lamp efficiency, and reduce the leakage flux of magnetic field which is a prime source of electromagnetic interference in the lamp structure.

In accordance with the present invention, the primary winding of the coupling transformer is spatially distributed so that the density of turns: that is, the number of turns per unit length varies as a function of angular position on the closed loop core. The turns are wound in proportion to the adjoining secondary plasma current density. Local matching of flux linkages per ampere reduces leakage flux between the primary and seconary to improve the lamp coupling and reduce electromagnetic radiation.

It is, therefore, an object of this invention to provide structures for reducing the amount of electromagnetic radiation produced by induction ionized fluorescent lamps.

Another object of this invention is to increase the over-all operating efficiency of induction ionized fluorescent lamp systems.

Another object of this invention is to reduce the output load requirements for power supplies in electrodeless fluorescent lamp systems.

BRIEF DESCRIPTION OF THE DRAWINGS

The novel features believed characteristic of the present invention are set forth in the appended claims. The invention itself, together with further objects and advantages thereof, may be understood by reference to the following detailed description taken in connection with the appended drawings in which:

DESCRIPTION OF THE PREFERRED EMBODIMENTS

Figure 1:
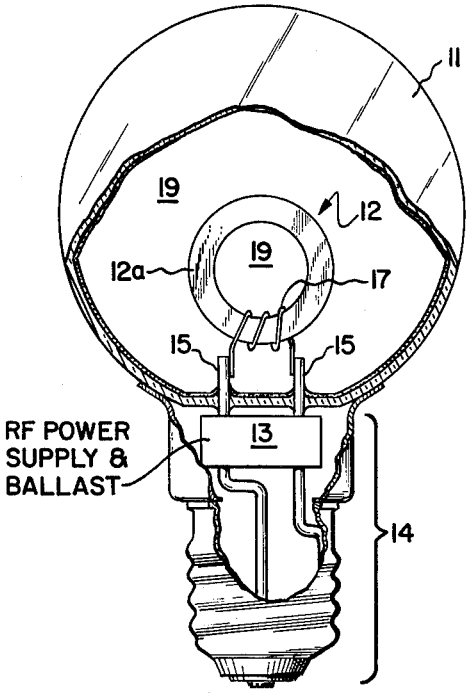
Fig. 1 (PRIOR ART)
FIGS. 1 and 2 ae induction ionized fluorescent lamps of the prior art.

The principles of operation of electrodeless fluorescent lamps are described in U.S. Pat. Nos. 3,500,118 and 3,521,120 which are incorporated herein by reference as background material. FIG. 1 is an induction ionized fluorescent lamp which is more particularly described in United States patent application Ser. No. 642,142 by John M. Anderson, issued U.S. Pat. No. 4,017,764. The specification of that patent application is incorporated herein by reference. A phosphor coated radiation transmissive envelope 11 contains an ionizable gas 19 and an exciting transformer 12 having a closed loop magnetic core 12*a*. A solid state radio frequency power supply and ballasting circuit 13 are enclosed in a base assembly 14 which is attached to the lamp envelope 11 and includes a standard Edison screw plug. The completed assembly resembles a conventional incandescent lamp with, for example, an envelope diameter of approximately 7.6 centimeters and is compatible with luminaires designed for that configuration. The transformer, which may advantageously comprise ferrite, is supported within the lamp envelope on metal rods 15 which serve to transmit power from the power supply 13 to a multi-turn winding 17 linking the core 12*a*. The number of turns in the winding is determined by the operating input voltage of the lamp. Typically, the windings may be chosen to allow one turn on the core for each five volts of winding input voltage. In lamps of the prior art, the winding turns are either uniformly distributed around the core 12*a* or are grouped for ease of manufacture.

The space within the envelope contains the ionizable gas 19 which may be chemically identical with that used in conventional fluorescent lamps and may comprise a mixture of a rare gas. For example, krypton or argon, with mercury vapor and/or cadmium vapor. The internal surfaces of the glass envelope 11 are coated with an appropriate ultraviolet-to-visible fluorescent phosphor, such as a calcium haloapetate, which phosphors are well known to the art. These phosphors are capable of absorbing the ultraviolet radiation of mercury vapor which is generally peaked at about 2537 A and, upon stimulation thereby, emitting radiation within the visible spectrum to produce a highly efficient and pleasing light output.

Figure 2:
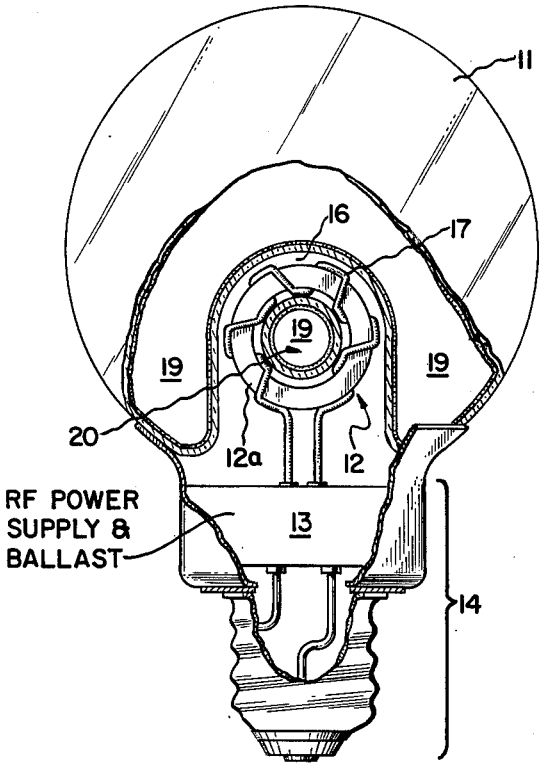
Fig. 2 (PRIOR ART)
Figure 3A:
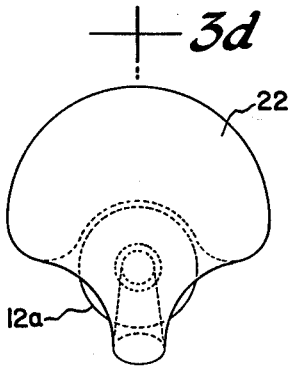
FIGS. 3*a* through 3*d* represent the plasma distribution within the lamp of FIG. 1.
Figure 3B:
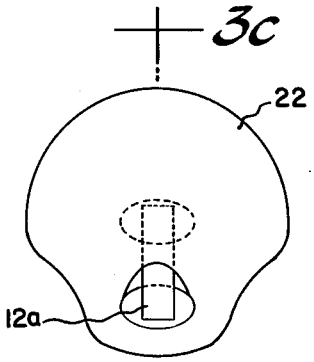
Figure 3C:
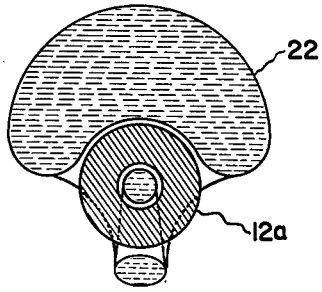
Figure 3D:
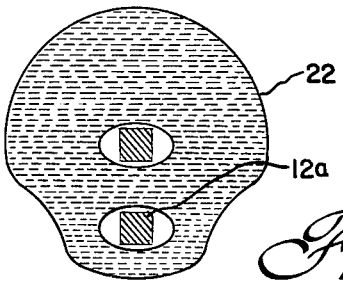

FIG. 2 is an induction ionized fluorescent lamp which is similar in construction to the lamp of FIG. 1 and which is more specifically described in allowed United States patent application Ser. No. 642,056, now issued U.S. Pat. No. 4,005,330, which is incorporated herein by reference. In this embodiment, the coupling transformer 12 is disposed within a substantially semicircular reentrant passage 16 in the lamp envelope 11. The magnetic core 12*a* and the primary winding 17 are, thereby, disposed outside the lamp envelope in atmospheric ambient, to improve heat conduction, minimize contamination of the fill gas 19, and allow ease of manufacture. A tunnel 20 links the envelope with the transformer core 12*a* and conducts the secondary plasma to provide a passage for the secondary current flow.

The lamps of FIGS. 1 and 2 provide highly efficient light output and are economical substitutes for incandescent lamps in existing luminaires. Leakage reactance which exists in the transformer 12*a*, as a result of imperfect coupling between the primary windings 17 and current flow in the gas 19, tends to degrade lamp efficiency, however, and may contribute to undesirable electromagnetic radiation from the lamp structure.

The current flow within the gas 19 is, generally, not symmetrically distributed about the transformer core 12. This nonuniform distribution is, in part, caused by fundamental asymmetry in the lamp structure and is also partially caused by the well-known negative impedance of current filaments flowing in an ionized gas. FIGS. 3*a* through 3*d* illustrate a typical distribution of a plasma cloud 22 about the transformer core 12*a* in a lamp constructed in the manner of FIG. 1. (All lamp parts with the exception of the transformer core 12*a* have been omitted for clarity of illustration.

We have determined that electromagnetic radiation from such lamps is, in part, attributable to a lack of uniformity between the distributions of transformer flux linkages and secondary current in the plasma. Radiation from electrodeless fluorescent lamps may be reduced from 3 dB to 6 dB and the lamp operating efficiency increased by spatially distributing winding turns on the closed loop transformer core 12*a* to match the flux linkages with the secondary current flow in the plasma.

Figure 4:
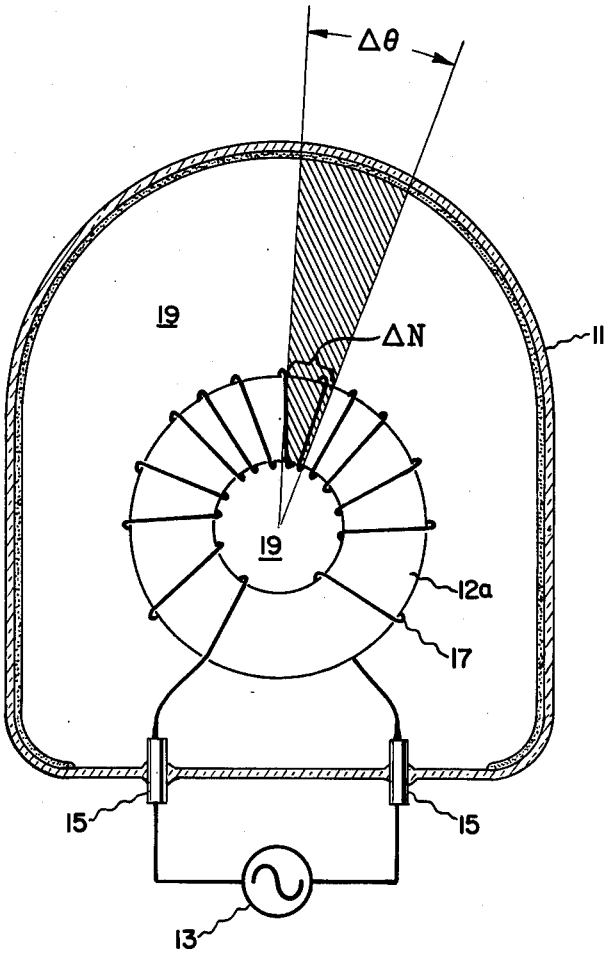
FIGS. 4 and 5 are induction ionized fluorescent lamps which include the improved transformer windings of the present invention.

FIG. 4 is an electrodeless fluorescent lamp of the type illustrated in FIG. 1 which contains a transformer of the present invention. A closed loop, high permeability magnetic core 12*a*, typically a ferrite toroid, is contained within a phosphor coated glass envelope 11 in an ionizable gas 19. An RF power supply and ballast circuit 13 supplies current flow through a multi-turn primary winding 17 on the core 12*a*. The angular distribution of winding turns 17 on the core 12*a* is not, as was the case in the prior art, either uniformly distributed or lumped within a small sector of the core. Rather, the turns of the primary winding 17 are distributed about the core in proportion to the localized plasma current which flows adjacent that core sector. Thus, the number of turns $\Delta N$ within the sector $\Delta \theta$ of the core 12*a* is proportional to the current flow in the shaded sector of the drawing between the envelope 11 and the transformer core 12*a*.

Figure 5:
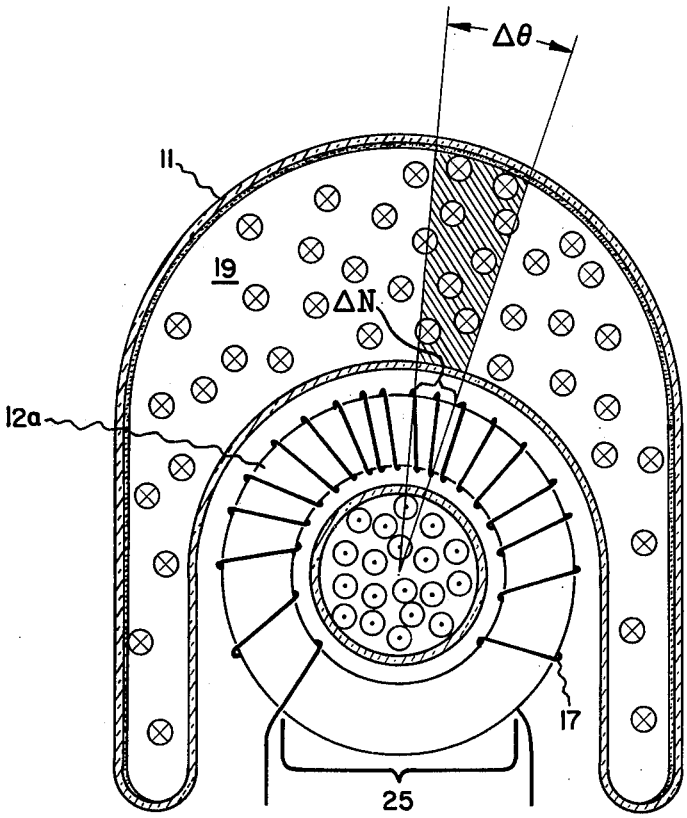

FIG. 5 is a lamp of the configuration of FIG. 2 which comprises a transformer of the present invention. In this configuration, current flow in the outer envelope is substantially confined to the upper region of the envelope shell (as indicated by the arrow tail symbols). Winding turns 17 on the core 12*a* are, as was the case in the lamp of FIG. 4, distributed in proportion to current flow in the adjacent sector of the lamp envelope outside the core. Inasmuch as no current flows adjacent the lower portions of the core 25, which are located outside the lamp envelope 11, the winding 17 is substantially confined to the side and top sectors of the cores.

The spatial distribution of transformer windings in proportion to adjacent current flow substantially increases coupling and reduces electromagnetic interference produced by electrodeless fluorescent lamps. The cost of radio frequency power supply and ferrite core components as well as operating costs and the cost of radio frequency shielding which might otherwise be required are, therefore, substantially reduced and the over-all operating efficiency of lighting systems is increased.

While the invention has been described in detail herein in accord with certain preferred embodiments thereof, many modifications and changes therein may be effected by those skilled in the art. Accordingly, it is intended by the appended claims to cover all such modifications and changes as fall within the true spirit and scope of the invention.

The invention claimed is:

1. In an induction ionized fluorescent lamp of the type comprising: an evacuable, light-transmissive envelope, a gaseous medium disposed within said envelope and capable of sustaining an electric discharge due to a varying magnetic field induced therein and to emit radiation at a first wavelength while sustaining said discharge, a luminous phosphor at least on the interior of said envelope capable of emitting visible light while being excited by said first wavelength radiation, a closed loop magnetic core with said gaseous medium disposed about said loop, and means for energizing said core with a varying magnetic field at radio frequency whereby said electric discharge is induced in said gaseous medium, the improvement wherein:

said means for energizing said core comprises a multi-turn winding linking said core and connected for receipt of radio frequency electrical current, the spatial distribution of said winding on said core being proportional to current flow in said electric discharge in adjacent regions and said gaseous medium.

2. The lamp of claim 1 wherein said magnetic core is a toroid and wherein the number of turns of said winding on a sector of said toroid is proportional to current flow in an adjacent sector of said gaseous medium disposed between said toroid and said envelope.

3. Apparatus for maintaining an electric discharge in a gaseous medium contained within an evacuable envelope comprising:

a closed loop magnetic core centrally disposed with respect to said envelope;

a multi-turn winding linking said core and adapted for energizing said core with a radio frequency magnetic field, the spatial distribution of said turns of said winding on said core being proportional to an adjacent current flow in said gaseous medium; and means for establishing a radio frequency electric current within said winding.

4. The apparatus of claim 3 wherein said core is a toroid and wherein the angular distribution of said turns on said toroid is proportional to current flow in an adjacent sector of said gaseous medium.

5. In apparatus for producing an electric current flow in a plasma, which apparatus includes a closed loop magnetic core linking said plasma, a multi-turn primary winding linking said core, and means for causing alternating current flow in said winding; the improvement wherein:

the turns of said winding are spatially distributed about said core with a density proportional to the current flow in adjacent regions of said plasma.

6. The apparatus of claim 5 wherein said core is a toroid and wherein the distribution of turns on a sector of said toroid is proportional to said current flow in an adjacent sector of said plasma.

* * * * *